US008787604B2

(12) United States Patent
Zhang et al.

(10) Patent No.: US 8,787,604 B2
(45) **Date of Patent: *Jul. 22, 2014**

(54) REMOTE CONTROL OF HEARING ASSISTANCE DEVICES

(75) Inventors: Tao Zhang, Eden Prairie, MN (US); Venkat Ramachandran, Hopkins, MN (US); Arthur Salvetti, Colorado Springs, CO (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/555,604

(22) Filed: Jul. 23, 2012

(65) Prior Publication Data

US 2012/0288127 A1 Nov. 15, 2012

Related U.S. Application Data

(63) Continuation of application No. 12/573,656, filed on Oct. 5, 2009, now Pat. No. 8,254,606.

(60) Provisional application No. 61/102,852, filed on Oct. 5, 2008.

(51) Int. Cl.
*H04R 25/00* (2006.01)

(52) U.S. Cl.
CPC ..... *H04R 25/558* (2013.01); *H04R 25/554* (2013.01)
USPC ..... 381/315; 381/320

(58) Field of Classification Search
CPC ..... H04R 25/55; H04R 25/554
USPC ..... 381/23.1, 312–315, 320, 321; 455/556.1, 556.2
See application file for complete search history.

(56) References Cited

U.S. PATENT DOCUMENTS

| | | | |
|---|---|---|---|
| 5,083,312 | A | 1/1992 | Newton et al. |
| 6,115,478 | A | 9/2000 | Schneider |
| 2002/0138164 | A1 | 9/2002 | David |
| 2007/0255435 | A1 | 11/2007 | Cohen et al. |
| 2007/0269067 | A1 | 11/2007 | Aschoff et al. |
| 2010/0142738 | A1 | 6/2010 | Zhang et al. |
| 2011/0085687 | A1 | 4/2011 | Edgar |

OTHER PUBLICATIONS

U.S. Appl. No. 12/573,656 , Response filed Feb. 7, 2012 to Non Final Office Action mailed Oct. 7, 2011, 7 pgs.
U.S. Appl. No. 12/573,656, Non Final Office Action mailed Oct. 7, 2011, 6 pgs.

(Continued)

*Primary Examiner* — Tuan D Nguyen
(74) *Attorney, Agent, or Firm* — Schwegman, Lundberg & Woessner, P.A.

(57) ABSTRACT

The present disclosure relates to methods and apparatus of communicating instructions to a hearing assistance device, such as a hearing aid. In various embodiments instructions are formed using tones sent to the hearing assistance device. The instructions can be used to control the operation of the hearing assistance device. The signals may include dual tone multi-function signals or other nonstandard signals. Various detection processes are provided which include but are not limited to using a modified complex Goertzel algorithm to detect tones. The remote device can be a standard device or can be modified to provide the proper signals. The following techniques can be applied to hearing assistance devices including, but not limited to completely-in-the-canal devices, in-the-canal devices, behind-the-ear devices, receiver-in-canal devices, and implanted devices, such as cochlear implants.

20 Claims, 8 Drawing Sheets

(56) References Cited

OTHER PUBLICATIONS

U.S. Appl. No. 12/573,656, Notice of Allowance mailed Feb. 22, 2012, 5 pgs.

U.S. Appl. No. 12/573,656, Notice of Allowance mailed May 31, 2012, 9 pgs.

U.S. Appl. No. 12/577,499, Notice of Allowance mailed May 10, 2012, 9 pgs.

REMOTE CONTROL OF HEARING ASSISTANCE DEVICES

TECHNICAL FIELD

The present application is a continuation of and claims the benefit of priority under 35 U.S.C. §120 to U.S. patent application Ser. No. 12/573,656, filed Oct. 5, 2009, which claims the benefit under 35 U.S.C. §119(e) of U.S. Provisional Patent Application Ser. No. 61/102,852, filed Oct. 5, 2008, the benefit of priority of each of which is claimed hereby, and each of which are incorporated by reference herein in its entirety.

This document relates to control of hearing assistance devices and more particularly to remote control of hearing assistance devices.

BACKGROUND

Hearing assistance devices facilitate hearing by wearers. One such hearing assistance device is a hearing aid. Wearers of hearing aids prefer that they be small in size, lightweight, not readily visible, and relatively low power to avoid frequent replacement of batteries. Such designs are available, yet control of such devices can be complicated due to their small size. Some designs include buttons and switches for adjustment of volume and other functions, but wearers frequently have difficulty changing settings and operating the devices with such small controls. Thus, there is a need in the art for a more elegant interface which wearers can use to control their hearing assistance devices.

SUMMARY

This document provides method and apparatus for control of hearing assistance devices, including hearing aids. The present disclosure relates to methods and apparatus of communicating instructions to a hearing assistance device, such as a hearing aid. In various embodiments instructions are formed using tones sent to the hearing assistance device. The instructions can be used to control the operation of the hearing assistance device. These instructions can be transmitted using audio signals, magnetic or near field radio frequency signals, far field radio frequency signals, or direct connections in various embodiments. The signals may include dual tone multifunction signals or other nonstandard signals. Various detection processes are provided which include but are not limited to using a modified complex Goertzel algorithm to detect tones. The remote device can be a standard device or can be modified to provide the proper signals. The following techniques can be applied to hearing assistance devices including, but not limited to completely-in-the-canal devices, in-the-canal devices, behind-the-ear devices, receiver-in-canal devices, and implanted devices, such as cochlear implants.

This Summary is an overview of some of the teachings of the present application and is not intended to be an exclusive or exhaustive treatment of the present subject matter. Further details about the present subject matter are found in the detailed description and the appended claims. The scope of the present invention is defined by the appended claims and their equivalents.

DETAILED DESCRIPTION

The following detailed description of the present invention refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is, therefore, not to be taken in a limiting sense, and the scope is defined only by the appended claims, along with the full scope of legal equivalents to which such claims are entitled.

Figure 1:
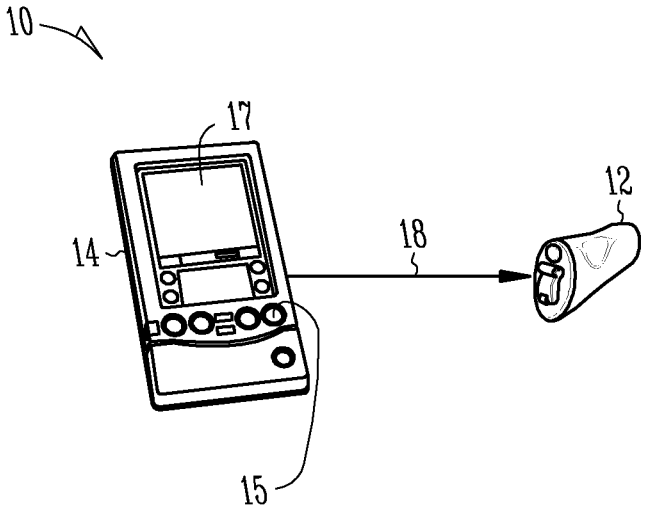
FIG. 1 shows a system where a remote device is operated to send signals to hearing assistance device, according to one embodiment of the present subject matter.

The present disclosure relates to methods and apparatus of communicating instructions to a hearing assistance device, such as a hearing aid. In various embodiments instructions are formed using tones sent to the hearing assistance device. The instructions can be used to control the operation of the hearing assistance device. These instructions can be transmitted using audio signals, magnetic or near field radio frequency signals, far field radio frequency signals, or direct connections in various embodiments. The signals may include dual tone multifunction signals or other nonstandard signals. Various detection processes are provided which include but are not limited to using a modified complex Goertzel algorithm to detect tones. The remote device can be a standard device or can be modified to provide the proper signals. The following techniques can be applied to hearing assistance devices including, but not limited to completely-in-the-canal devices, in-the-canal devices, behind-the-ear devices, receiver-in-canal devices, and implanted devices, such as cochlear implants. FIG. 1 shows a system 10 where a remote device 14 is operated to send signals to hearing assistance device 12, according to one embodiment of the present subject matter. The hearing assistance device 12 is demonstrated as a completely-in-the-canal hearing aid; however, it is understood that other hearing assistance devices and other hearing aids may be used without departing from the scope of the present subject matter. Such other hearing aids include, but are not limited to, in-the-canal devices, behind-the-ear devices, receiver-in-canal devices, and implantable devices, such as cochlear implants.

Remote device 14 includes input controls 15 that are operable to send signals to hearing assistance device 12. Input controls 15 may vary, and include, but are not limited to, buttons, switches, touch pads, potentiometers, capacitive sensing devices, magnetic sensing devices, optical sensing devices, and combinations of two or more thereof. The number of input controls 15 may vary without departing from the scope of the present subject matter.

Remote device 14 transmits signals 18 to hearing assistance device 12 to perform a variety of functions. One such function is the control of hearing assistance device 12. Such controls include, but are not limited to, one or more of: power on, power off, volume up, volume down, muting on, muting off, adjusting frequency response, triggering a particular functionality, adjusting a plurality of settings (for example, changing memory to adjust several memory settings at once), and combinations thereof.

The signals 18 include, but are not limited to one or more of, acoustic signals, magnetic or near field radio frequency signals, direct audio input signals, far field radio frequency signals, and combinations thereof.

Remote device 14 transmits acoustic signals from transmission means 17. In acoustic transmission embodiments, transmission means 17 is a speaker. In magnetic transmission embodiments, transmission means 17 is an inductive transmission circuit. In direct audio transmission embodiment, transmission means 17 is an electrical connection from an external audio device to the direct audio input (DAI) connector of a hearing assistance device. In radio frequency transmission embodiments, transmission means 17 is a radio frequency transmitter. It is understood that in various embodiments, remote device 14 may have two or more of the foregoing transmission means. For example, it is understood that a cordless phone may employ a speaker, the speaker may produce a magnetic field as modulated by the electronics of the phone when producing sound, and it may also include a wireless component for transmitting signals. Thus, it is contemplated that one or more transmission means may be available depending on the choice of particular remote device 14.

Figure 2:
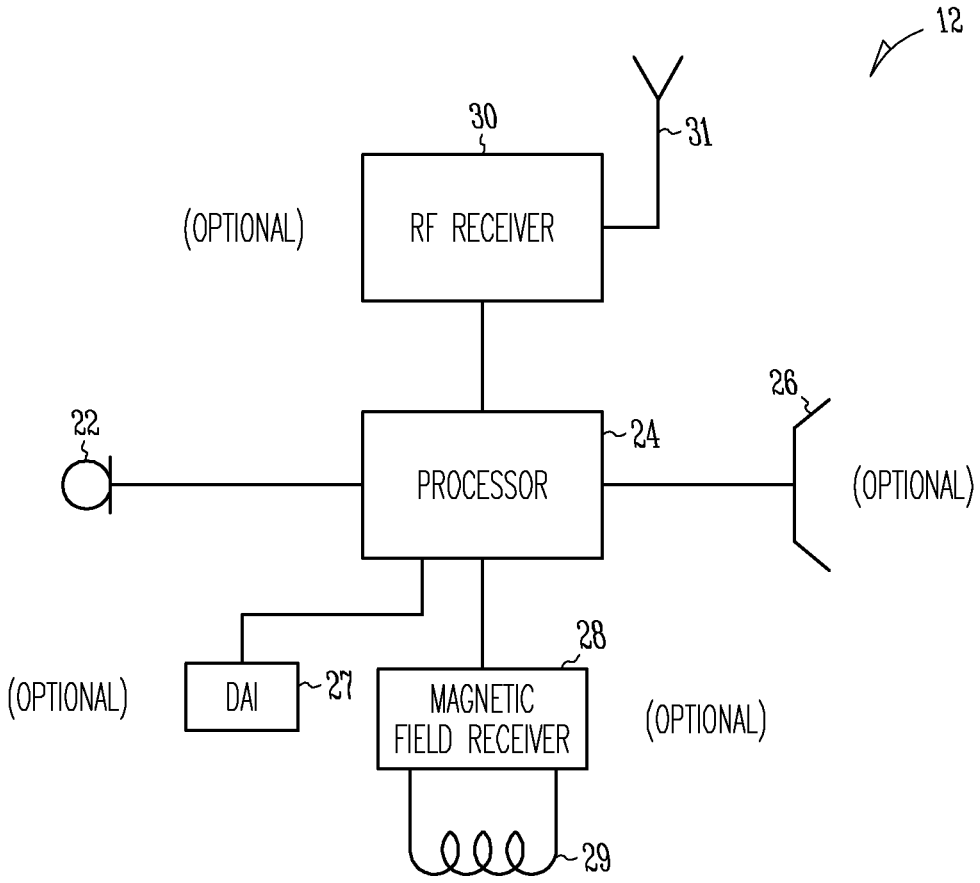
FIG. 2 shows a hearing assistance device and some components, according to one embodiment of the present subject matter.

FIG. 2 shows hearing assistance device 12 and some components, according to one embodiment of the present subject matter. Hearing assistance device 12 includes a microphone 22, and a processor 24. Hearing assistance device 12 optionally includes a speaker or "receiver" 26, which is used in devices providing acoustic signals to the wearer. In devices, such as cochlear implants, a receiver 26 is replaced with appropriate lead connections (not shown).

Also optional is a magnetic field receiver 28 and its associated inductive antenna 29. Such devices are also known as "telecoils" and are useful for reception of modulated magnetic fields. Such devices include, but are not limited to, one or more of reed switches, Hall effect switches, magnetoresistive sensors (for example giant magnetoresistive sensors and anisotropic magnetoresistive sensors, also known as GMR and AMR sensors), and associated sensing circuitry. Such circuits can receive audio band signals from modulation of the magnetic field of a telephone receiver or other magnetic field modulation source. Upon detection of a magnetic field, such circuits have been used to provide a mixed signal from reception by the microphone 22 and from reception by the magnetic field receiver 28, and, in some cases, only reception of the signal from the magnetic field receiver 28 is used. The received signal, whether mixed or not, can be processed by processor 24 and then provided to the receiver 26 (or leads if the device is implanted). Magnetic field receiver 28 is adapted to receive magnetic signals from remote device 14 in embodiments where magnetic or inductive communications are employed.

Another optional component is the radio frequency receiver 30 and its radio frequency antenna 31. The radio frequency receiver 30 is adapted to receive radio signals from the remote device 14, demodulate them, and provide the demodulated signal to processor 24 to perform functions as set forth herein.

Another optional component is a direct audio input (DAI) port or connector 27, which is provided to receive audio signals from remote device 14 via direct connection. The DAI port is provided to receive audio signals directly from the remote device 14 and provide them to processor 24 to perform functions as set forth herein.

Accordingly, in embodiments where the remote device 14 produces acoustic signals 18, the microphone 22 of hearing assistance device 12 will receive the signals 18 which can then be processed by processor 24. In embodiments where remote device 14 produces magnetic (also referred to as "near field" signals herein) modulated signals 18, the magnetic field receiver 28 receives the magnetic signals which are processed by processor 24. In embodiments where remote device 14 produces radio frequency modulated signals 18 (also referred to as "far field" signals herein) radio frequency receiver 30 receives the radio frequency signals which are processed by processor 24. In embodiments where remote device 14 produces direct audio signals 18, DAI port 27 receives the audio signals which are processed by processor 24.

Various different signals 18 can be used in different embodiments. In various embodiments, signals 18 are touch tone signals produced by a telephone, cell phone, cordless phone, military phone, or other tone generation device. In various embodiments, dual tone multi-frequency (DTMF) tones are used. In various embodiments, hashed or encrypted audio sounds are used. In various embodiments, a spread spectrum noise approach is used. Other sounds may be employed without departing from the present subject matter. It is understood that the signals 18 can be transferred by various ways, including, but not limited to, one or more of acoustically, over magnetic communications, and over radio frequency communications, or combinations thereof as set forth herein.

In various embodiments, to prevent an unintended control message from being transmitted by remote device 14, a special key or key sequence is used to enable or disable the hearing assistance device from responding to the signals 18 from remote device 14.

Every reception mode provides the possibility of noise or other unwanted input signals besides the desired signals 18, so different detection approaches are possible. In one embodiment, a subband Goertzel algorithm is used to detect the signals 18. The subband Goertzel algorithm will be demonstrated with respect to detection of DTMF touch tones; however, this is only used to demonstrate the present subject matter and is not intended to be limiting or exclusive of the other modulation approaches of signals 18 set forth herein.

One problem with discrete Fourier transforms and fast Fourier transforms is that it is not very efficient to estimate the Fourier transform coefficients at a small number of frequencies although it is very efficient to estimate the coefficients at larger number of frequencies. This problem can be overcome by evaluating samples at the actual DTMF frequencies using a nonuniform DFT, as in the case of the Goertzel algorithm. The squared magnitude of the frequency samples are computed using a modified Goertzel algorithm.

Figure 3:
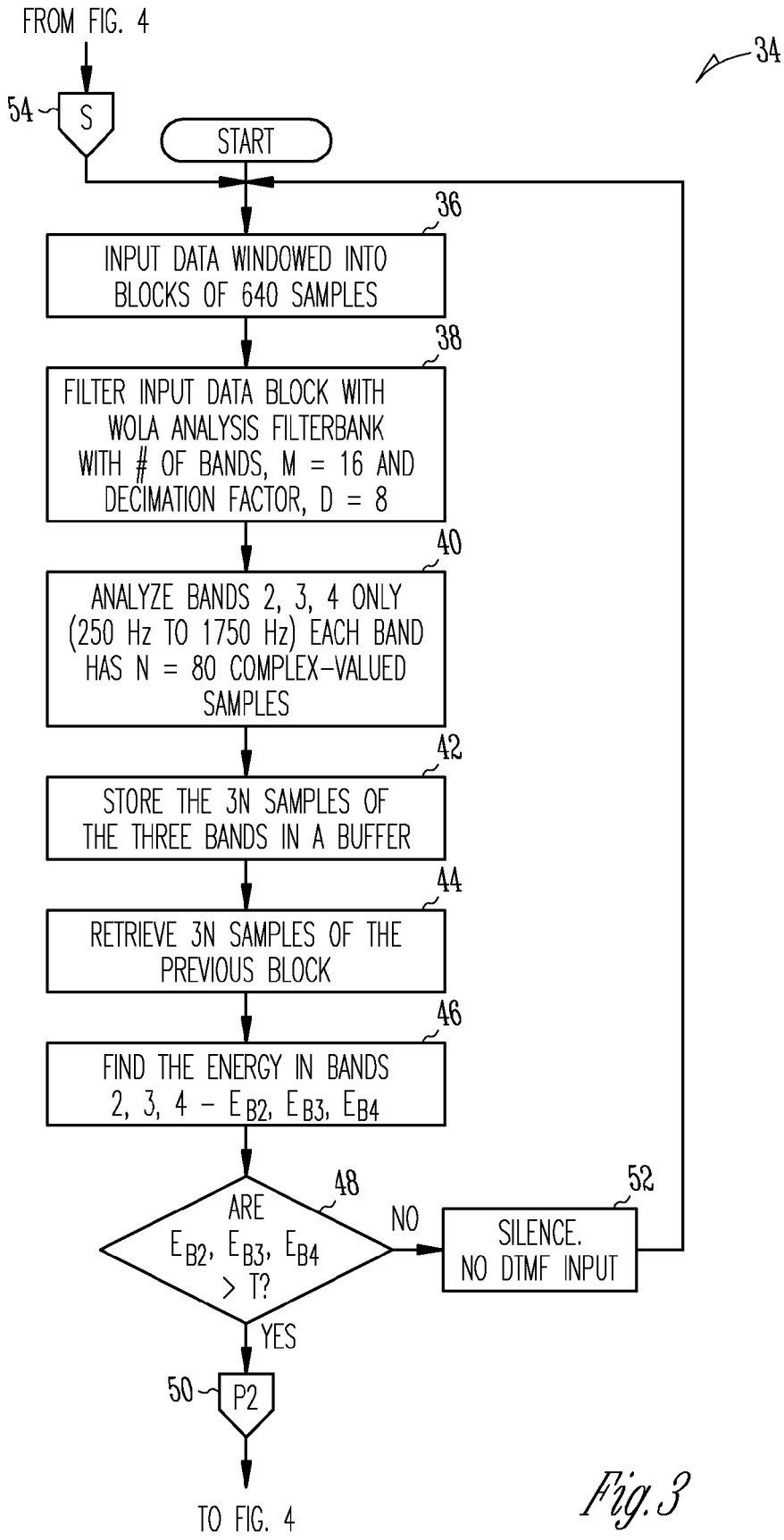
FIGS. 3-4 show a subband modified Goertzel algorithm used to detect signals for the desired input signal, according to one embodiment of the present subject matter.
Figure 4:
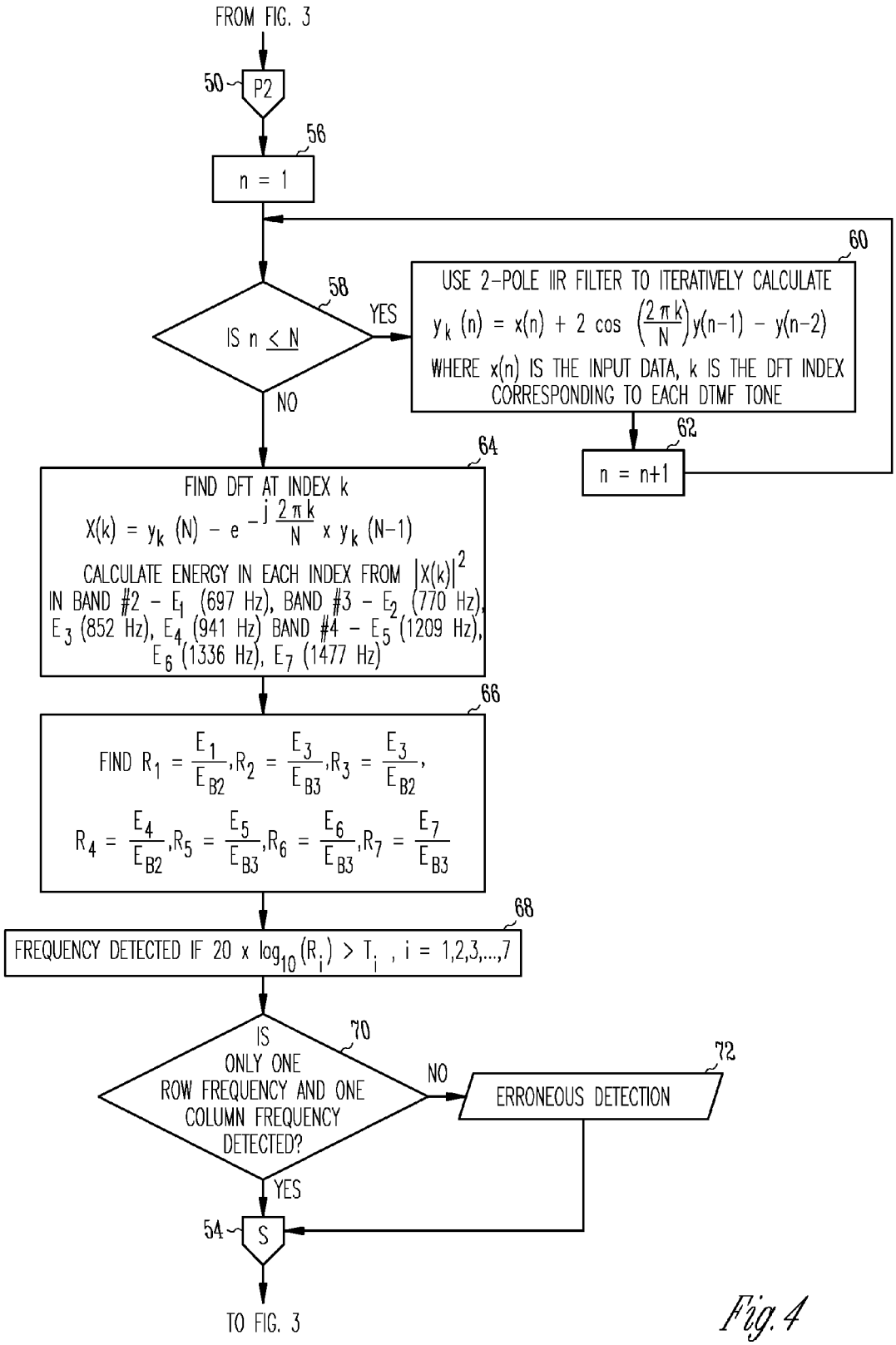

FIGS. 3-4 show a subband modified Goertzel algorithm used to detect signals 18 for the desired input signal, according to one embodiment of the present subject matter. In the cases where touch tones are not used, the following algorithm is readily adapted based on the frequency nature of the signals modulating signal 18.

The basic process amounts to determining where the frequencies of interest exist, using a complex Goertzel algorithm to detect the energy at the possible tone frequencies, if the energy detected exceeds the band energy by a given threshold, then deeming the signal to be a tone of interest detected. If multiple tones are used and properly detected, then a detection of the multiple tone signal is deemed to have occurred.

Figure 6:
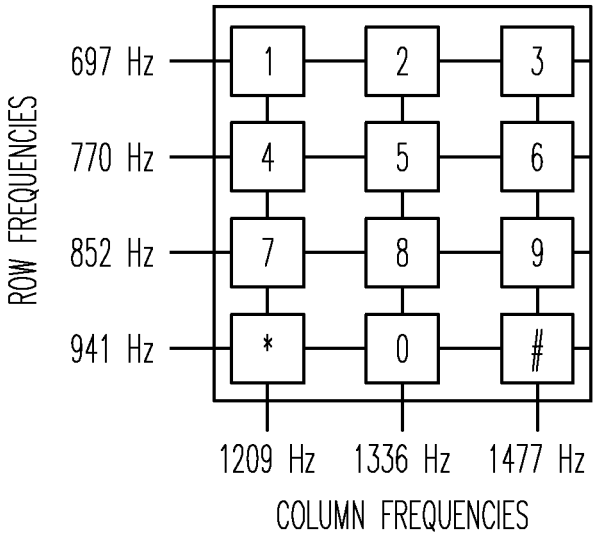
FIG. 6 shows a mapping of DTMF frequencies to a keypad for each keypress.
Figure 7:
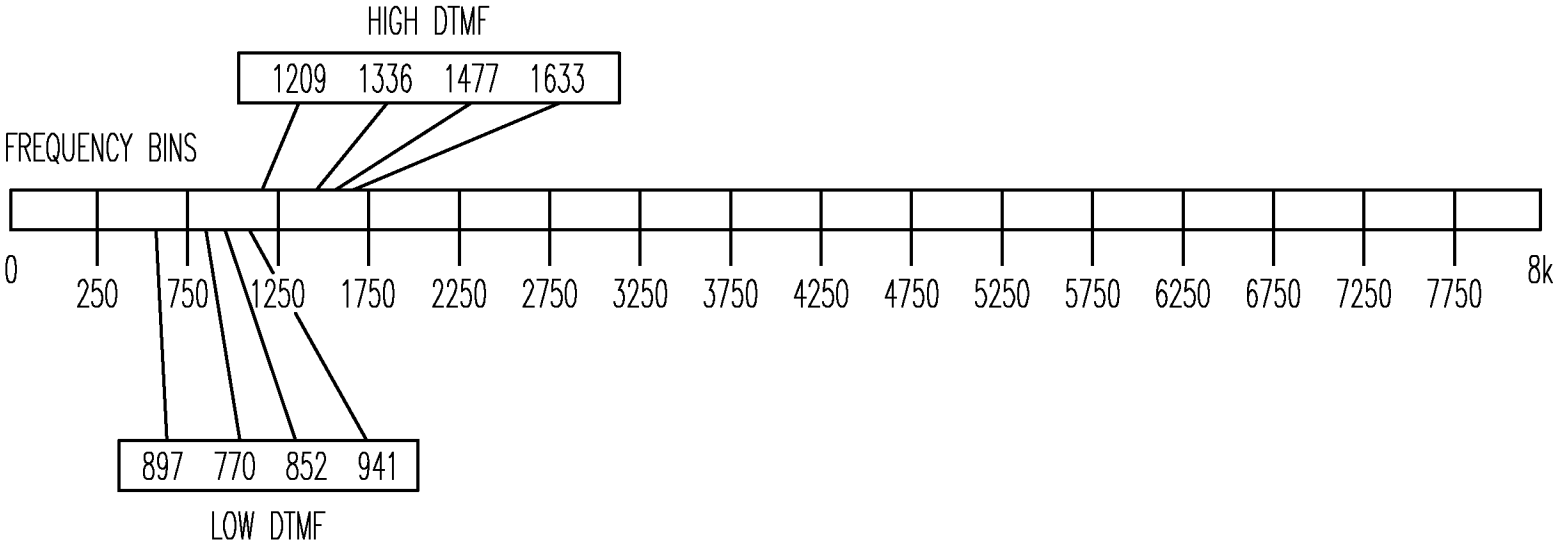
FIG. 7 shows a mapping of the frequencies of a DTMF keypad to bands in a WOLA analysis filterbank, according to one embodiment of the present subject matter.

The process shown in FIGS. 3-4 is initiated at times to provide detection of the touch tones from signal 18 as sent by the remote device 14. If the received signal 18 is demodulated and the information in the signal is processed to provide digital samples of input data stored in memory. The subband Goertzel process 34 in FIG. 3 begins by windowing the input data into blocks of samples (36). In this example 640 samples are used based on a system where each band has N=80 complex-valued samples and each sample has 8 words. Therefore, there are 80×8=640 samples in each block. The resulting blocks are filtered with a WOLA (Weighted OverLap and Add) analysis filterbank with a number of bands, M=16, and decimation factor, D=8 (38). The information is thereby converted from the time domain to the frequency domain. The resulting frequency domain information can then be analyzed where the tone frequencies are expected to occur (40). In applications where a standard DTMF signal is concerned, these bands cover the frequencies of interest. As shown in FIG. 6 for embodiments employing commercial DTMF signals seven tone frequencies of interest are possible: 697 Hz, 770 Hz, 852 Hz, 941 Hz, 1209 Hz, 1336 Hz, and 1477 Hz. (Military DTMF designs offer an eighth tone 1633 Hz in band 3). In this example, bands 2, 3, and 4 are analyzed to simplify the analysis (250 Hz to 1750 Hz). A chart of the frequencies is shown in FIG. 7. As each complex sample for each band is generated, the subband Goertzel algorithm is applied. Samples are stored in memory (42) and can be retrieved as needed (44) to estimate energy. The energy in each band is rapidly estimated (46). If calculations are performed quickly, then this analysis has relatively little processing overhead and can be referenced momentarily without large disruption to overall processing.

The energy of each band is calculated using the following equation:

$E_k(n)=(1\text{-alpha})*E_k(n-1)+\text{alpha}*|x_k(n)|\hat{}2$, where $E_k(n)$ is the energy for band k at block n; alpha is a positive number between 0 and 1; $x_k(n)$ is the complex subband output for band k, and k is the DFT index corresponding to each tone.

If it is determined that the energy in each of the bands is less than a predetermined threshold amount, T, (48), then the signal is deemed to not have the tone input (52) and the process can be initiated again at block (36) when desired. If any of the three bands have energy above the predetermined threshold amount, T, (50) then the flow goes to FIG. 4. The loop on FIG. 4 including blocks (56), (58), (60), and (62) is repeated N times to perform infinite impulse response (IIR) filtering of the 640 input samples for each index k. The formula for the 2 pole IIR filter is:

$$y_k(n)=x_k(\mathrm{n})+2\cos(2*pi*k/N)*y_k(n-1)-y_k(n-2).$$

Once that IIR filtering is performed, the discrete Fourier transform at each index k, Y(k), is generated and the energy in each index from the square of the magnitude of Y(k) is determined at each frequency of interest as denoted by index k (64). The energy of each tone is then compared with the energy in its respective band to provide relative threshold comparisons that are independent of input level (66). Once the comparisons are performed between the relative energy per tone and the threshold per tone (68), a final check can be performed to ensure that the tones detected are consistent with the tone paradigm (e.g., in DTMF there can be only one row frequency tone and only one column frequency tone to have a valid detection) (70). If an erroneous set of tones is detected (72) the process is indeterminative, and is repeated. If the tones are consistent, then the detected tones can be stored and eventually associated with a function to be performed by the hearing assistance device 12.

Figure 5:
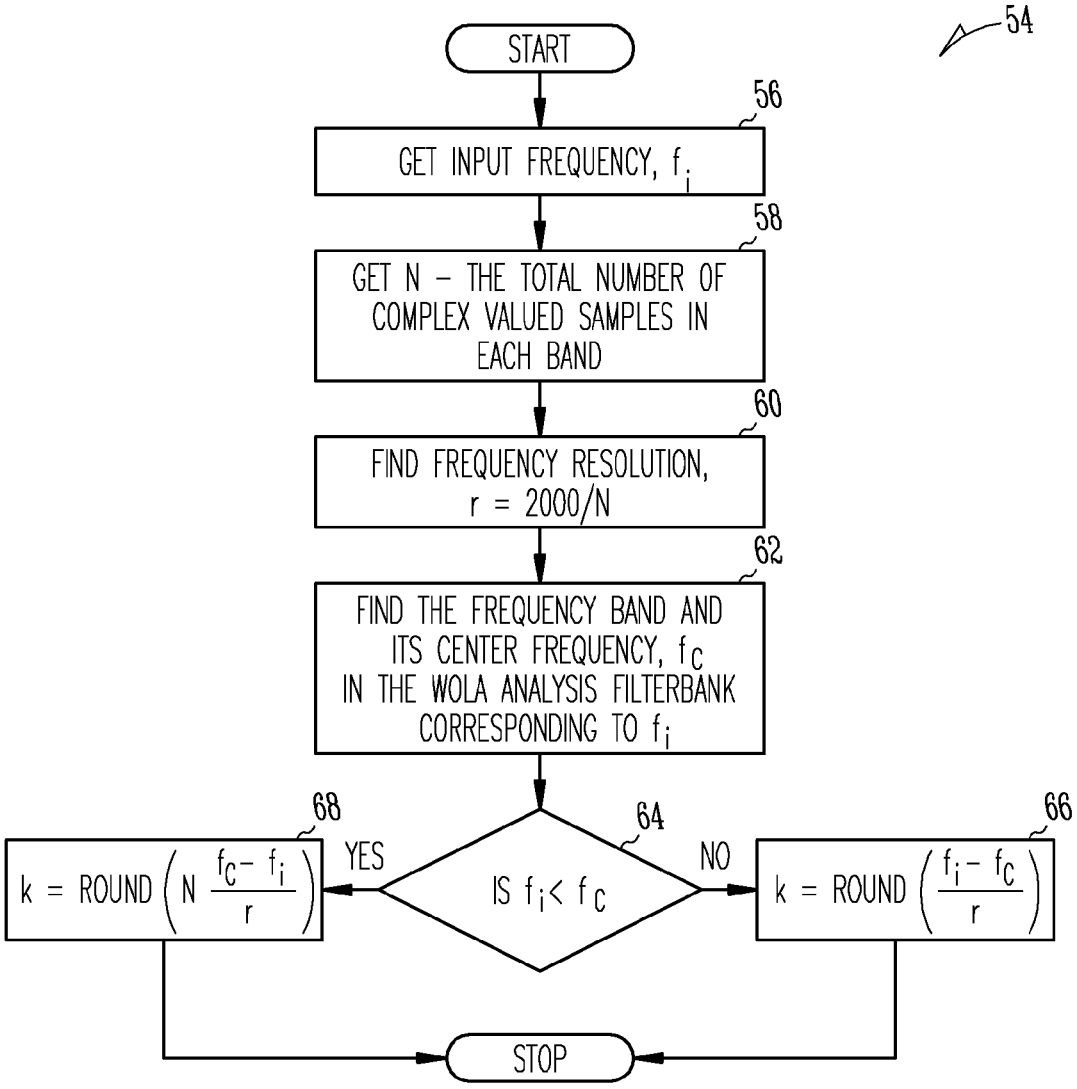
FIG. 5 shows the calculations performed for generating the discrete Fourier index, k, for each tone of interest, according to one embodiment of the present subject matter.

FIG. 5 shows the calculations performed for generating the discrete Fourier index, k, for each tone of interest, according to one embodiment of the present subject matter. The process (54) is performed for each tone of interest designated by index i. The frequency of interest, $f_i$;, is obtained (56) and the total number of complex-valued samples in each band is determined (58). The frequency resolution, r, is calculated by the equation (60):

$$r=2000/N.$$

The center frequency of each frequency band in the WOLA analysis filterbank $f_c$ is determined (62). If $f_i$, is less than $f_c$ (64) then k=round $(N-(f_c-f_i)/r)$ (at 68), else k=round $((f_i-f_c)/r)$ (at 66).

Figure 8:
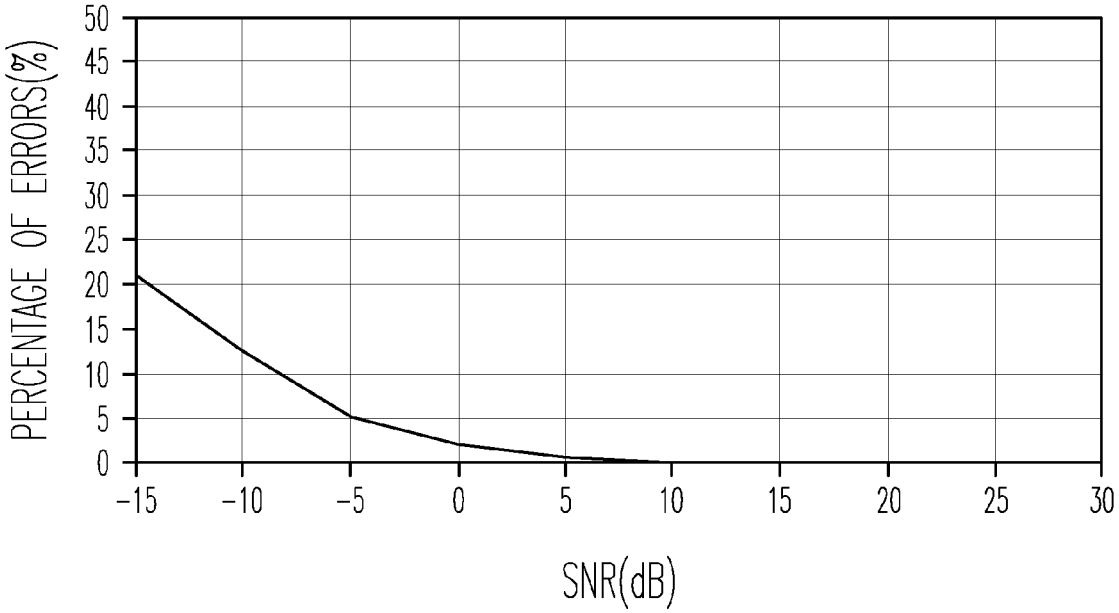
FIG. 8 shows performance data for a hearing assistance device receiving DTMF signals with speech interference, according to one embodiment of the present subject matter.

FIG. 8 shows performance data for a hearing assistance device receiving DTMF signals with speech interference, according to one embodiment of the present subject matter. A plot of signal-to-noise ratio (SNR) and percentage of errors shows that errors less than about 5 percent can be achieved for a SNR greater than −5 dB. In this plot and the following plots, percentage of errors is defined as the ratio of the number of erroneous detections divided by the number of DTMF tones transmitted.

Figure 9:
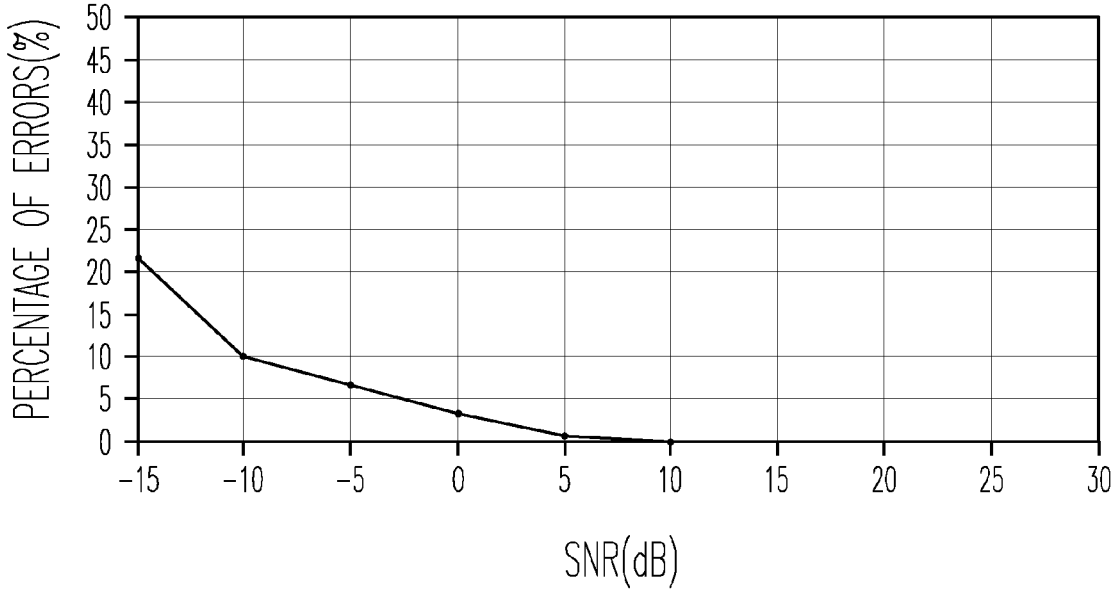
FIG. 9 shows performance data for a hearing assistance device receiving DTMF signals with music interference, according to one embodiment of the present subject matter.

FIG. 9 shows performance data for a hearing assistance device receiving DTMF signals with music interference, according to one embodiment of the present subject matter. Speech and a combination of piano and flute music were added to generate the interference in this plot. A plot of signal-to-noise ratio (SNR) and percentage of errors shows that errors less than 5 percent can be achieved for a SNR greater than about −3 dB.

One advantage of the present methods is that the mapping between touch tones and hearing aid functions/controls can be programmed. The mapping can be changed at will and reprogrammed.

The computational cost for detecting tones can be reduced by performing frequency identification in the subband domain, as opposed to the time domain. It can also be reduced by activating the detection algorithm only when the energy in the relevant bands is greater than a threshold. It can also be reduced by running the detection algorithm as infrequently as possible. In one embodiment, the tone detection algorithm detects a tone no more than every 20 milliseconds. This approach is provided for demonstration, and it is understood that other values are possible without departing from the scope of the present subject matter.

It is understood that the filter parameters, algorithms, and steps provided herein were given to demonstrate the present subject matter and are not intended to be exhaustive or exclusive of the ways the present subject matter can be practiced.

Using the teachings provided herein, it is understood that a common keypad of a telephone, cell phone, cordless phone, or other DTMF generator can be used to send signals to the hearing assistance device adapted to perform the decoding described herein. Where standard DTMF signals are used, a key sequence can be adapted to perform the functions set forth herein, and others not expressly stated herein. For example, a key sequence of "5" and then "2" could be pressed to perform "volume up" and a key sequence of "5" and then "8" could be pressed for volume down. The key sequence could be abbreviated to a single digit. In these examples, a key prefix (or suffix) could be used to let the hearing assistance device know that the following keys (or in the case of a suffix, preceding keys) were an instruction and not an accidental keypress or some other normal telephone dialing activity. For example a "*" or a "#" keypress might be used as a prefix (or suffix). A process executing on the processor is programmed to recognize the keypresses and operate the hearing assistance device accordingly. It is understood that a variety of keypress operations may be employed without departing from the present subject matter.

In embodiments using nonstandard signals, the remote device 14 is programmed to generate the signal of interest upon inputs to the remote device 14. In cases where remote device is a cellular phone or other wireless telephone device, the programming can be downloaded to generate the nonstandard audio signals associated with each keypress. Thus, nonstandard signals can be mapped to keypresses or other inputs of remote device 14, and are ultimately received and used by hearing assistance device 12.

The present subject matter includes hearing assistance devices, including but not limited to, cochlear implant type hearing devices, hearing aids, such as behind-the-ear (BTE), in-the-ear (ITE), in-the-canal (ITC), or completely-in-the-canal (CIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in the ear canal of the user. It is understood that other hearing assistance devices not expressly stated herein may fall within the scope of the present subject matter.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. A hearing aid, comprising:

a telecoil to receive a signal; and a programmable processor in communication with the telecoil, the programmable processor configured to perform program instructions for a Goertzel process for detection of information encoded in the signal at predetermined tone frequencies of interest, the information including a control message, the programmable processor programmed to perform a control process based on the control message, the processor further adapted to perform hearing aid processing.

2. The hearing aid of claim 1, wherein the Goertzel process is adapted to process subband information in subbands including the predetermined tone frequencies of interest.

3. The hearing aid of claim 1, wherein the Goertzel process is adapted to process subband information to obtain the information encoded in the signal.

4. The hearing aid of claim 1, wherein the Goertzel process is adapted to decode information sent as dual tone multi-function signals for use in controlling the hearing aid.

5. The hearing aid of claim 4, wherein the processor is programmed to recognize at least some of the dual tone multi-function signals such that they provide at least part of the control message.

6. The hearing aid of claim 1 further comprising a microphone.

7. The hearing aid of claim 6 further comprising a receiver.

8. The hearing aid of claim 6 further comprising a radio frequency receiver.

9. The hearing aid of claim 6 further comprising a direct audio input (DAI) port.

10. The hearing aid of claim 1, further comprising a microphone, a receiver, and a direct audio input port in communication with the programmable processor.

11. The hearing aid of claim 10, wherein the Goertzel process is adapted to process subband information in subbands including the predetermined tone frequencies of interest.

12. The hearing aid of claim 10, wherein the Goertzel process is adapted to process subband information to obtain the information encoded in the signal.

13. The hearing aid of claim 10, wherein the Goertzel process is adapted to decode information sent as dual tone multi-function signals for use in controlling the hearing aid.

14. The hearing aid of claim 13, wherein the processor is programmed to recognize at least some of the dual tone multi-function signals such that they provide at least part of the control message.

15. The hearing aid of claim 1, further comprising a magnetic field receiver.

16. The hearing aid of claim 1, further comprising a receiver in communication with the programmable processor, wherein the hearing aid is configured to play sound at least in part derived from the hearing aid processing performed by the programmable processor.

17. The hearing aid of claim 1, wherein the hearing aid includes an in-the-canal device.

18. The hearing aid of claim 1, wherein the hearing aid includes a behind-the-ear device.

19. The hearing aid of claim 1, wherein the hearing aid includes a receiver-in-canal devices.

20. The hearing aid of claim 1, wherein the hearing aid includes an implantable device such as a cochlear implant.

* * * * *